US006360454B1

(12) United States Patent
Dachgruber et al.

(10) Patent No.: US 6,360,454 B1
(45) Date of Patent: Mar. 26, 2002

(54) TONGUE STIFFENER FOR FOOTWEAR

(75) Inventors: Susanne Dachgruber, San Clemente; Catherine Bailey; Sung-Ho Joe Tan, both of San Francisco, all of CA (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/457,121

(22) Filed: Dec. 7, 1999

Related U.S. Application Data

(60) Provisional application No. 60/111,309, filed on Dec. 7, 1998.

(51) Int. Cl.[7] ..... A43B 23/26; A43B 5/04

(52) U.S. Cl. ..... 36/54; 36/117.1; 36/119.1

(58) Field of Search ..... 36/117.1, 119.1, 36/54

(56) References Cited

U.S. PATENT DOCUMENTS

| | | | |
|---|---|---|---|
| 194,361 | A | 8/1877 | McGuigan |
| 438,466 | A | 10/1890 | Booz |
| 522,371 | A | 7/1894 | Horn et al. |
| 641,689 | A | 1/1900 | Garrod |
| 643,783 | A | 2/1900 | Traylor |
| 737,959 | A | 9/1903 | Posner |
| 1,253,777 | A | 1/1918 | Bromley |
| 1,309,958 | A | 7/1919 | Phillips |
| 1,489,000 | A | 4/1924 | Mitchell |
| 1,548,172 | A | 8/1925 | Redden |
| 1,692,896 | A | 11/1928 | Hilgert |

(List continued on next page.)

FOREIGN PATENT DOCUMENTS

| | | | |
|---|---|---|---|
| CA | 494979 | | 8/1953 |
| CH | 662 483 | A5 | 12/1978 |
| CH | 654 467 | A5 | 2/1986 |
| DE | 213181 | | 3/1924 |
| EP | 0 647 414 | A1 | 4/1995 |
| EP | 0 672 364 | A2 | 9/1995 |
| EP | 0 695 515 | A2 | 2/1996 |
| FR | 1 193 946 | | 11/1959 |
| GB | 213181 | | 4/1924 |
| WO | WO97/32496 | | 9/1997 |

OTHER PUBLICATIONS

International Search Report for International Application No. PCT/US01/00287 dated Apr. 27, 2001.

IPER for International application No. PCT/US99/29141 dated Mar. 26, 2001.

Partial English translation of EP 0 672 364 A2, cited on May 30, 2000, extending from line 23 to line 47 of p. 5.

English Language Abstract of EP 0 672 364 A2, cited May 30, 2000.

*Primary Examiner*—Ted Kavanaugh

(74) *Attorney, Agent, or Firm*—Wolf, Greenfield & Sacks

(57) ABSTRACT

A tongue construction for footwear is configured with a tongue and a stiffener that is able to move relative to the tongue, thereby resisting pinching of the rider's foot as the boot is flexed. As a result, footwear having desired stiffness while substantially reducing discomfort, especially during flexing of the footwear is provided. By allowing the stiffener to slide rather than bend, or at least to reduce the extent of bending of the stiffener, pinching of the dorsal area near the ankle may be minimized as may be digging of the stiffener into the dorsal area near the toe. Consequently, a soft or hybrid snowboard boot is provided that provides both enhanced power transmission as well as improved wearer comfort.

84 Claims, 5 Drawing Sheets

U.S. PATENT DOCUMENTS

| | | | | | |
|---|---|---|---|---|---|
| 2,073,542 | A | | 3/1937 | Walters | |
| 2,210,430 | A | | 8/1940 | Post | |
| 2,211,822 | A | | 8/1940 | Jennings | 36/8.5 |
| 2,742,715 | A | | 4/1956 | Meltzer | 36/2.5 |
| 3,419,974 | A | | 1/1969 | Lange | |
| 3,849,914 | A | | 11/1974 | Bertele | |
| 4,391,049 | A | | 7/1983 | Parisotto | |
| 4,461,103 | A | * | 7/1984 | Annovi | |
| 4,470,206 | A | | 9/1984 | Annovi | 36/121 |
| 4,509,276 | A | | 4/1985 | Bourque | 36/115 |
| 4,733,484 | A | * | 3/1988 | Delery | |
| 4,766,612 | A | | 8/1988 | Patton, Sr. | 2/161 |
| 4,788,782 | A | | 12/1988 | Pozzebon et al. | |
| 4,920,666 | A | | 5/1990 | Marega | 36/119 |
| 4,928,405 | A | | 5/1990 | Spademan | |
| 5,050,319 | A | | 9/1991 | Perotto et al. | 36/117 |
| 5,113,526 | A | | 5/1992 | Wang et al. | 2/2 |
| 5,174,050 | A | | 12/1992 | Gabrielli | 36/117 |
| 5,265,353 | A | | 11/1993 | Marega et al. | 36/117 |
| 5,276,983 | A | | 1/1994 | Hatfield | 36/138 |
| 5,289,645 | A | | 3/1994 | Marega et al. | 36/54 |
| 5,513,450 | A | | 5/1996 | Palazzo | 36/128 |
| 5,553,402 | A | | 9/1996 | Marega et al. | 36/117.7 |
| 5,575,090 | A | | 11/1996 | Condini | |
| 5,606,808 | A | | 3/1997 | Gilliard et al. | 36/89 |
| 5,611,155 | A | | 3/1997 | Brown et al. | 36/118.2 |
| 5,647,146 | A | | 7/1997 | Gabrielli et al. | 36/54 |
| 5,659,979 | A | | 8/1997 | Sileo | 36/54 |
| 5,711,092 | A | | 1/1998 | Despres et al. | 36/72 |
| 5,720,119 | A | | 2/1998 | Benoit | 36/117.1 |
| 5,894,684 | A | | 4/1999 | Sand et al. | |
| 6,128,837 | A | | 10/2000 | Huang | |

* cited by examiner

TONGUE STIFFENER FOR FOOTWEAR

CROSS-REFERENCE TO RELATED APPLICATIONS

This application claims the benefit of U.S. Provisional Patent Application No. 60/111,309, filed Dec. 7, 1998, which is herein incorporated by reference in its entirety.

BACKGROUND OF THE INVENTION

1. Field of the Invention

The invention relates to footwear, and more particularly to a tongue stiffener for footwear.

2. Related Art

Snowboard boots provide a rider with a selected combination of flexibility and support for comfort and board response. Snowboard boots also provide the rider with good "feel" or feedback from the board as it traverses terrain to allow for improved board control in a variety of conditions.

Board control may be affected by the stiffness of the boot. With increased stiffness, such as provided with hard boots, comes increased force transmission and greater board control. However, hard boots may be uncomfortable, especially while walking. On the other hand, flexible boots (soft and hybrid boots) may be less responsive to rider induced forces but are more comfortable. Hybrid boots include features of both soft and hard boots. In this respect, hybrid boots may include a rigid or semi-rigid sole and an upper portion divided into a rigid or semi-rigid lower portion and a flexible top portion.

Boots are known which attempt to balance the comfort of a soft or hybrid boot with the force transmission of a hard boot. These soft or hybrid boots may include a tongue configured with a rigid member or stiffener for imparting stiffness and resulting power transmission particularly on toe-side turns. Such tongue constructions, however, may create pressure points on a user's foot or leg when the boot is flexed. In this respect, as a rider leans against the top portion of the boot tongue during a toe-side maneuver, the stiffener may bend at the mid-section, which may pinch the dorsal area of the rider's foot near the ankle. In addition, flexing of the tongue may cause the front end of the tongue stiffener to dig into the dorsal area of the rider's foot near the toe.

SUMMARY OF THE INVENTION

The present invention is directed to a tongue stiffener and to a tongue including a tongue stiffener (hereinafter referred to as tongue constructions) that provide enhanced footwear stiffness. The tongue stiffener may be adapted to conform to the shape of the footwear tongue and is configured for movement relative to the tongue as the footwear is flexed forwardly. By allowing the stiffener to move in a controlled manner pinching of the dorsal area near the ankle may be minimized as may be digging of the stiffener into the dorsal area near the toe or shin. Pinching by the stiffener may further be controlled by forming flex inducing members along at least a portion of the sides of the stiffener. Consequently, footwear including the inventive tongue stiffener arrangement provides both repeatable enhanced power transmission as well as improved wearer comfort. In addition, the stiffener may include apertures for receiving stiffness adjusters for varying the flexibility of the stiffener.

In one illustrative embodiment of the invention, a tongue construction for an article of footwear includes a tongue and a tongue stiffener. The tongue stiffener includes an elongated body having a first portion engaged to the tongue and a second portion movable relative to the tongue as the tongue is flexed forwardly. Movement of the second portion thereby reduces pressing of the stiffener into the tongue.

Various embodiments of the present invention provide certain advantages. Not all embodiments of the invention share the same advantages and those that do may not share them under all circumstances. This being said, the present invention provides numerous advantages including the noted advantage of providing repeatable increased stiffness to a soft or hybrid boot while reducing discomfort during flexing of the boot.

Further features and advantages of the present invention, as well as the structure and operation of various embodiments of the present invention are described in detail below with reference to the accompanying drawings.

BRIEF DESCRIPTION OF THE DRAWINGS

The invention will now be described, by way of example, with reference to the accompanying drawings, in which.

DETAILED DESCRIPTION

Figure 1:
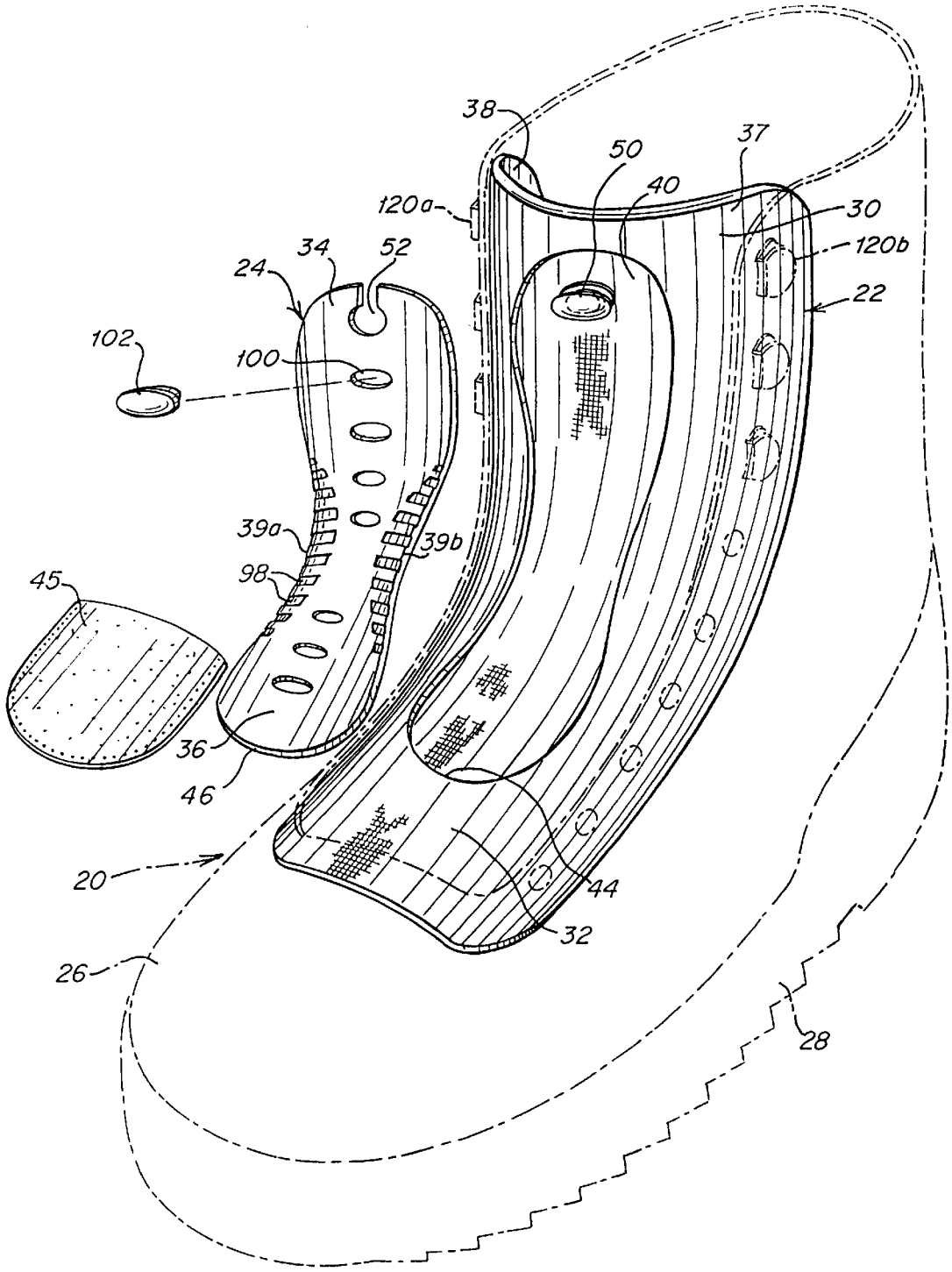
FIG. 1 is an exploded perspective view of a boot including a tongue construction configured with a tongue and a tongue stiffener according to one aspect of the present invention.
Figure 2:
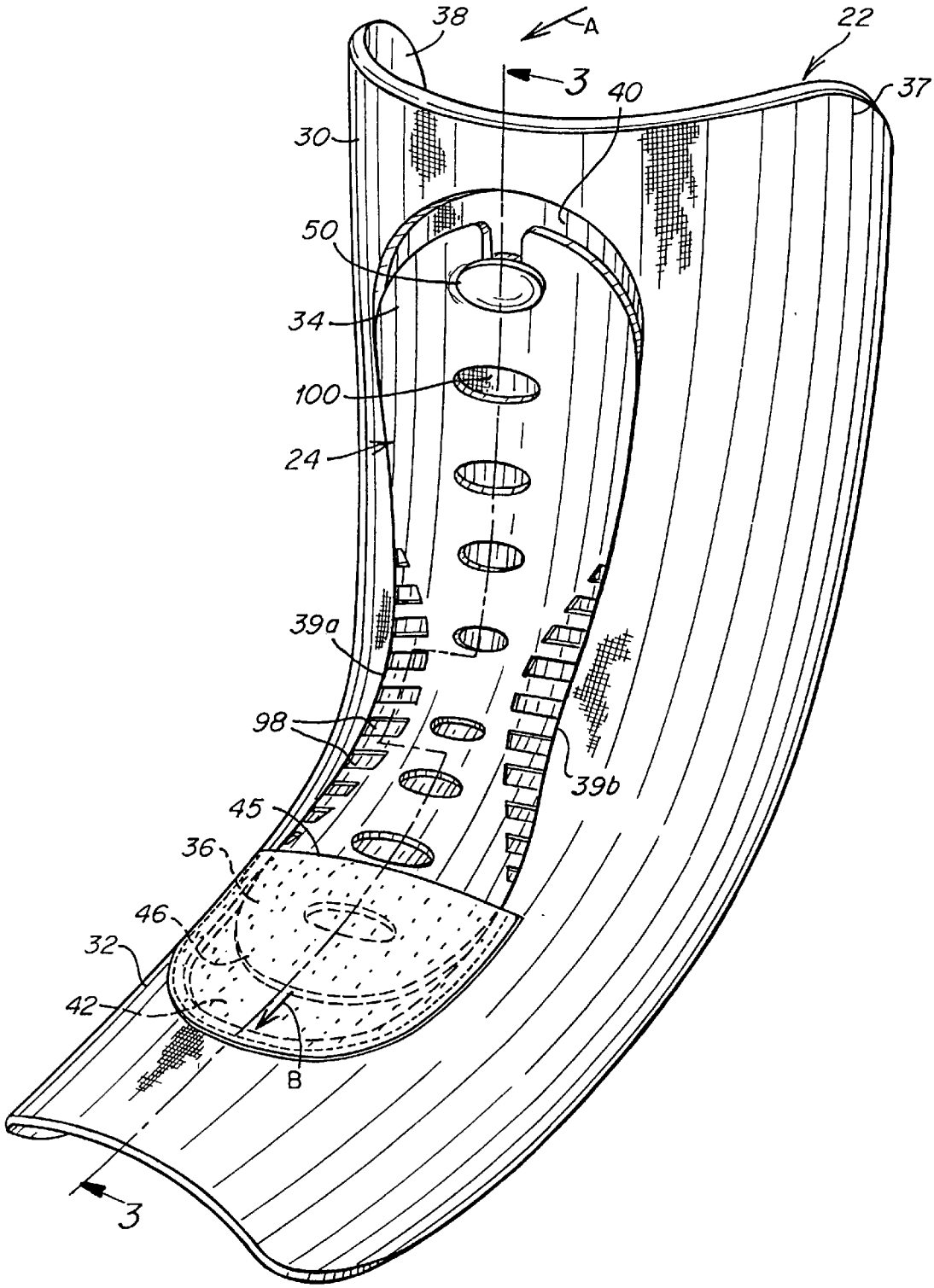
FIG. 2 is an assembled perspective view of the tongue construction of FIG. 1.
Figure 3:
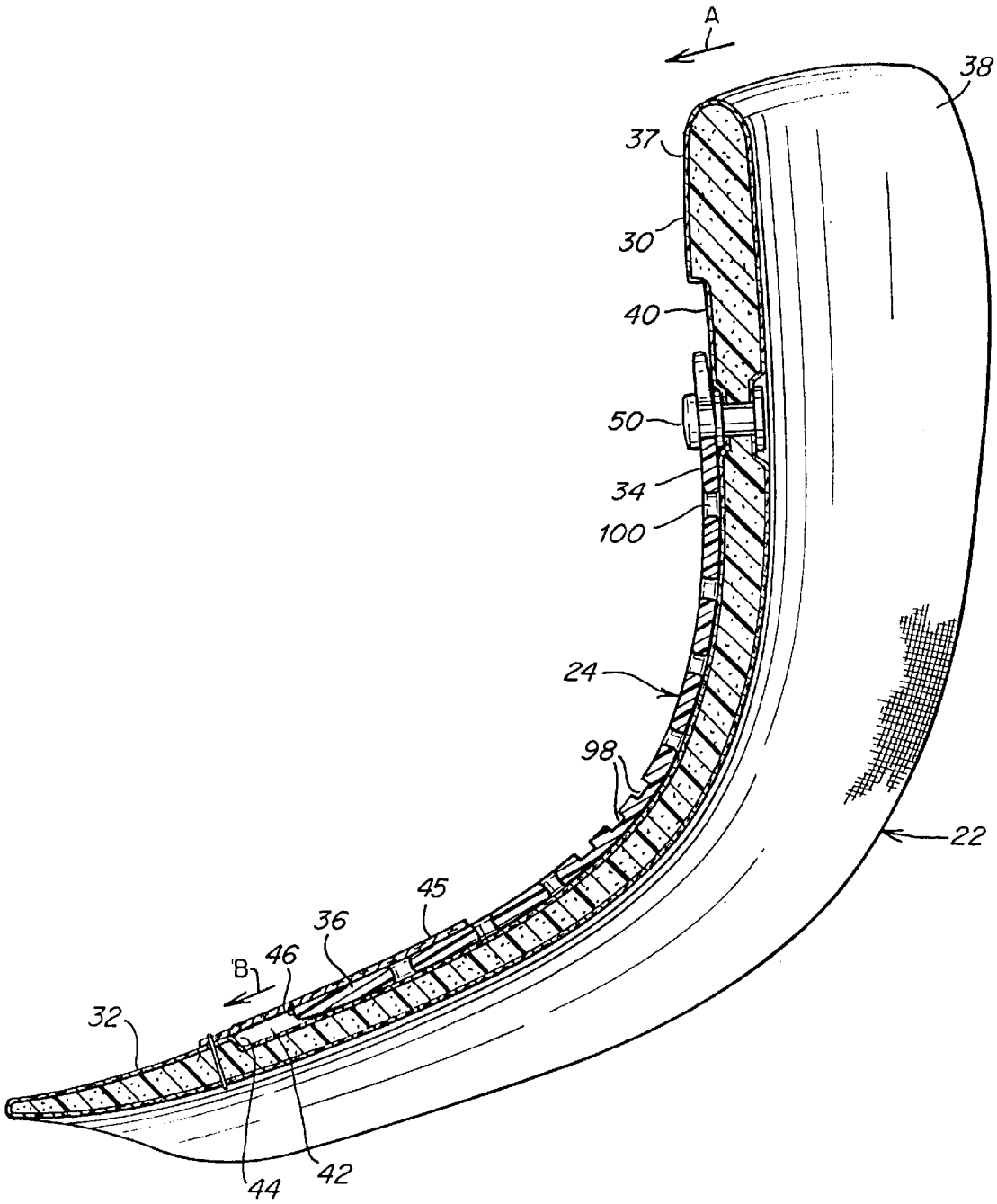
FIG. 3 is a cross-sectional view of the tongue construction taken along line 2—2 of FIG. 2.

FIGS. 1–3 show a tongue stiffener 24 according to one illustrative embodiment of the invention. The tongue stiffener 24 is constructed and arranged to cooperate with a tongue 22 of an article of footwear, such as a boot 20. The stiffener is engaged with the tongue in a manner to allow movement relative to the tongue 22, at least along a shin-to-toe direction. In one embodiment, the stiffener 24 is attached to the shin portion of the tongue 22 (hereafter referred to as the upper end 30) but includes a limited region of unconstrained movement at the toe region of the tongue 22 (hereafter referred to as the lower end 32). Thus, an upper end 34 of the stiffener 24 is attached to an upper end 30 of the tongue 22 and a lower end 36 of the stiffener 24 is not attached to the lower end 32 of the tongue 22. Therefore, as the boot is flexed in a direction shown as arrow A in FIGS. 2 and 3, the lower end 36 of the stiffener 24 is free to move, such as by sliding, in a direction shown by arrow B, relative to and over, or along the surface of, the tongue 22. Movement of the stiffener 24 as the tongue 22 (or boot) is flexed reduces the likelihood of discomfort to the rider; in this respect, pinching of the dorsal area of the rider's foot near the ankle by the mid-section of the stiffener as well as digging into the dorsal area near the rider's toe by the leading end of the stiffener may be minimized. Although the stiffener 24 moves relative to the tongue 22, it nevertheless cooperates with the tongue 22 to provide a stiffer tongue construction through which to transmit rider induced forces particularly on toe side turns as compared to the same tongue but having no stiffener.

Flexing in the medial or lateral direction also may be provided by allowing the stiffener 24 to move in a sideways, or partially sideways direction, relative to the tongue 22. In this respect, as the rider rolls his foot outwardly (laterally) or inwardly (medially), the stiffener 24 may shift over the tongue 22. If the stiffener 24 was otherwise constrained, the stiffened tongue 22 would resist medial or lateral flexing, thereby potentially limiting the performance and comfort of the boot.

In the embodiments described herein, the tongue stiffener overlies an outward facing surface 37 of the tongue 22. However, it is to be appreciated that the present invention is not limited in this respect and that other suitable locations may be utilized. For example, the tongue stiffener 24 may be mounted within the tongue or may underlie the tongue 22 on an inward facing surface 38 of the tongue 22.

Figure 4:
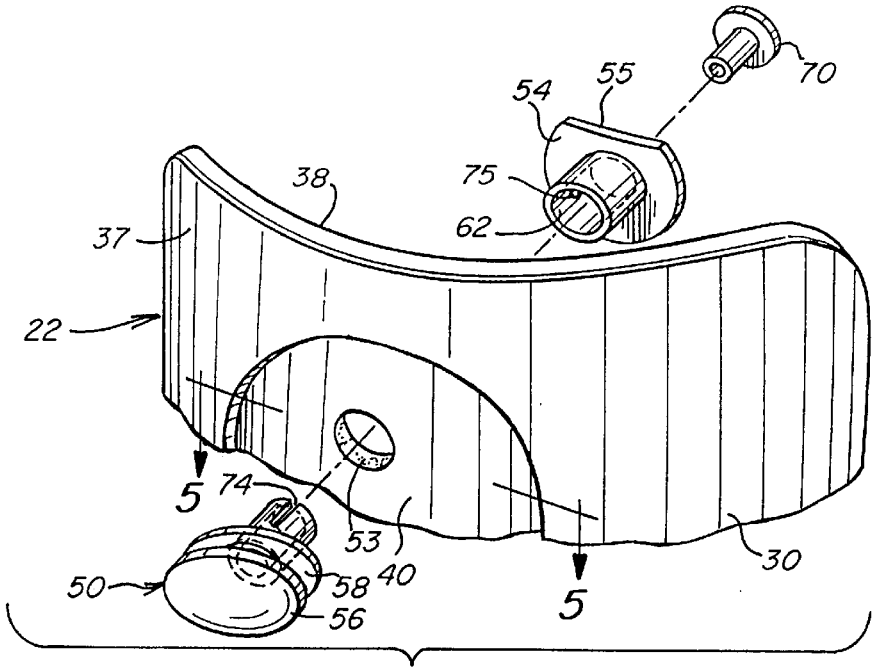
FIG. 4 is an exploded perspective view of a portion of the tongue construction showing attachment of the tongue stiffener to the tongue.
Figure 5:
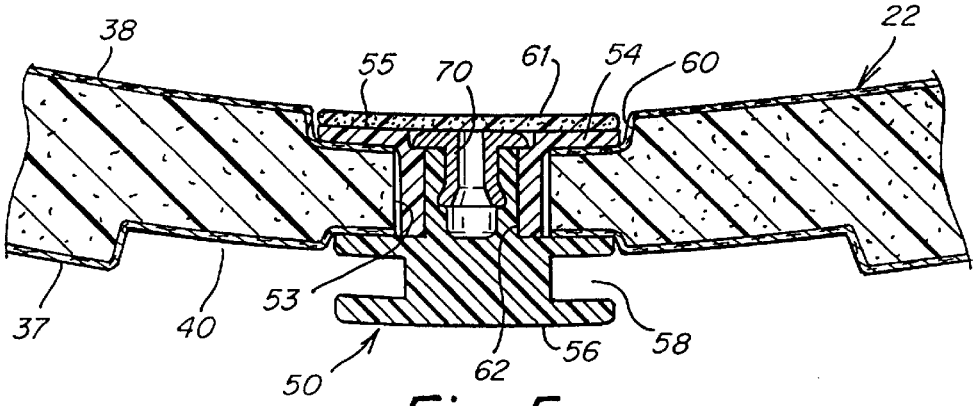
FIG. 5 is an assembled cross-sectional view of the tongue construction of FIG. 4 taken along line 5—5 of FIG. 4.

The stiffener 24 may be permanently or removably attached to the tongue 22. In one illustrative embodiment, as shown in FIGS. 1–3, a hook 50, which may be attached to the upper end 30 of the tongue 22, may be used. The stiffener 24 may include a slot 52 which is adapted to engage with the hook 50. As best shown in FIGS. 4 and 5, the tongue 22 may be formed with an opening 53 at the upper end 30 thereof to receive the hook 50 therein. Of course, the present, invention is not limited in this respect and the hook 50 may be attached to tongue 22 by any suitable arrangement. Other, suitable attachment techniques may be employed, such as screws, rivets, hook and loop fasteners, stitches, pockets, straps, adhesives, clamps, etc. A pocket may be formed either within the tongue body itself or by simply stitching a cover over the surface of the tongue. The tongue stiffener may also be configured with grooves that fit into corresponding guides in the tongue. The tongue stiffener may be fixed to the tongue to provide a controlled movement of the stiffener in a shin-to-toe direction relative to the tongue upon flexing. In this respect, each time the tongue is flexed, the tongue stiffener may be able to return to its original position. Thus, whenever subsequent flexing occurs, a similar performance of the boot may be provided.

Although the stiffener 24 is shown as fixed at the upper end 30 of the tongue 22, it is to be appreciated that the present invention is not limited in this respect and that other suitable fixing locations may be provided so long as at least a portion of the stiffener 24 is capable of moving relative to the tongue 22 as the tongue or footwear is flexed. For example, the stiffener 24 may be fixed at an intermediate point, such as along one or both sides, with free upper and lower ends. Alternatively, the stiffener 24 may be fixed at the lower end with a free upper end. Other suitable locations or combination of locations will be apparent to one of skill in the art. It is to be appreciated, however, that fixing a portion of the tongue stiffener at a particular location should allow the other portions of the tongue stiffener to move relative to the tongue so as to prevent pressing of the tongue stiffener against any portion of the wearer's foot and/or leg.

Continuing with reference to FIGS. 2 and 3, the tongue stiffener 24 may be shorter than the tongue. In this respect, the lower end of the tongue stiffener is spaced from the lower edge of the tongue and the upper end of the tongue stiffener is spaced from the upper edge of the tongue. In one embodiment the tongue 22 may be formed with a recess 40 configured to receive the tongue stiffener 24. The recess 40 may be longer than the tongue stiffener 24, thereby defining an open area 42 between the lower end 36 of the stiffener 24 and a lower edge 44 of the recess 40. The open area 42 provides a path for the tongue stiffener 24 to move in the recess 40 upon flexing of the boot. The open area 42 should be long enough to allow the stiffener to slide through a predetermined angle of flex of the footwear. For example, the recess 40 may be configured to allow the footwear to be flexed up to an angle of 45° from its rest position, without the end of the stiffener abutting the end of the recess. In one embodiment, the recess 40 is about 2 cm longer than the tongue stiffener 22, although more or less distance may be provided. Although the recess 40 is longer than the tongue stiffener 24, it should be appreciated that the present invention is not limited in this respect and that the recess 40 may be made substantially the same size as the tongue stiffener 24, where the tongue stiffener 24 is not intended-to move appreciably relative to the tongue 22.

In the embodiments where the bottom end of the tongue stiffener is fixed to the bottom end of the tongue, an open area may be formed at the top of the recess in which the tongue stiffener may move when the boot is flexed forwardly. The extent to which the tongue stiffener moves may be limited so as not to press into the rider's leg. The length of the stiffener may be less than the length of the tongue to ensure that, upon flexing, the tongue stiffener does not extend beyond the upper end of the tongue.

Similarly, in embodiments where the tongue stiffener is fixed at an intermediate location, the recess may be configured to provide an open area at an upper end, at a lower end or at both the upper and lower ends. Also, if no recess is provided, the ends of the stiffener should be spaced from the corresponding ends of the tongue.

The recess 40 formed in the tongue 22 may also allow the tongue 22 and tongue stiffener 24 to form a slender profile. In one embodiment, the recess has a depth about equal to the thickness of the tongue stiffener such that presence of the stiffener 24 does not create a pressure point against the wearer's foot or leg. For example, the boot may be configured with closure devices, such as laces, straps, cables, cords, and other devices recognized by those of skill in the art, that extend across the tongue of the boot. Tightening of the closure devices may cause a downward force on the tongue that can be distributed over both the surface of the tongue as well as the stiffener, rather than just over the stiffener, because, in this embodiment, the stiffener does not protrude beyond the profile of the tongue. Rather, the stiffener is disposed within the recess. If the stiffener was to protrude beyond the surface of the tongue, (i.e., not received within the recess), then the force of the closure devices would act only on the stiffener, potentially causing an uncomfortable pressure point. It should be appreciated that such a downward force on the tongue and stiffener may not only arise from tightening a wearer's foot within the boot, but also may arise when securing the boot to a strap binding for a snowboard where the strap extends across the front of the boot, as is the case with convention tray bindings for snowboards.

Of course, it should be appreciated that the present invention is not limited in this respect and that a recess need not be provided or may be deeper or shallower, as desired, with a desirable, although not required, corresponding change in the thickness of the tongue stiffener.

To aid in maintaining the stiffener 24 adjacent the tongue 22 while allowing for relative movement between the two, a cover 45 may be stitched or otherwise joined to the tongue 22. The cover 45 may also function to loosely constrain or to limit shin-to-toe movement and medial and/or lateral movement of the stiffener 24. The cover 45 may be formed of leather or a synthetic fabric or other suitable material that is durable yet sufficiently resilient to allow controlled flexing or movement of the stiffener 24. Although a cover 45 is illustrated, other arrangements for maintaining the tongue stiffener 24 adjacent the tongue 22 may be utilized. The cover may also loosely constrain shin-to-toe movement while restricting medial and/or lateral movement of the stiffener 24. Alternatively, the cover may restrict movement of the tongue stiffener in the shin-to-toe direction but may loosely constrain medial and/or lateral movement of the stiffener. In addition, such an arrangement may be configured to loosely hold the tongue stiffener adjacent the tongue such that limited movement of the tongue stiffener away from the surface of the tongue may be provided.

One such arrangement includes harnessing the stiffener 24 with a band extending across at least the lower end 36 of the stiffener 24 or with the laces of the boot as the laces are tightened. The width of the band may be sufficient to extend a substantial portion of the length of the stiffener. Another such arrangement includes providing the tongue 22 and stiffener 24 with a post and mating slot to receive the post. The post is able to slide within the slot to allow relative movement of the stiffener and the tongue. Another arrangement includes forming a pocket in the tongue 22 so that at least the lower end 36 of the stiffener 24 may be held therewithin. Other suitable arrangements will be apparent to one of skill in the art. In addition, it is to be appreciated that no such arrangement is necessary for the stiffener 22 to function according to the invention.

Referring now in particular to FIG. 3, which is a cross-sectional view of the tongue 22 taken along line 3—3 of FIG. 2, in one illustrative embodiment, the lower end 36 of the stiffener 24 may be formed with a tip 46 having a tapered, stepped or other suitably narrowing dimensioned cross-section. In one embodiment, the tip narrows from a thickness of about 2 mm to a thickness of about 1 mm. This narrowing dimensioned tip 46 facilitates movement of the stiffener 24 relative to the tongue 22, thereby allowing the stiffener 24 to easily glide over the tongue 22 and reducing the likelihood of the stiffener 24 catching on the surface of the tongue 22. In addition, the width of the lower end of the tongue stiffener may taper toward the tip. Such tapering may be suitable to further facilitate movement of the stiffener relative to the tongue. This tapering may also facilitate insertion of the stiffener beneath the cover or into another suitably configured arrangement to hold the lower end of the stiffener adjacent the tongue. Further, the surfaces of the stiffener may be lightly textured so as to permit ease of movement relative to the tongue and other components of the footwear.

Continuing with the illustrative embodiment of FIGS. 4 and 5, the hook 50 may include a base 54, having an inwardly facing side 55, and an insert 56. The insert 56 may include an annular region 58 that snap fits into the opening 52 of the stiffener 24 to hold the stiffener relative to the tongue 22 at the upper end 30 thereof. The base 54 of the hook 50 may be received in a depression 60 formed on the inwardly facing surface 38 of the tongue 22 so that the hook 50 does not protrude into the area of the boot occupied by the wearer's shin. In this respect, the hook 50 does not interfere with the comfort of the tongue 22 against the wearer's shin. To enhance the comfort, a foam covering 61 may be glued or otherwise attached over the inwardly facing side 55 of the base 54. However, it should be appreciated that the present invention is not limited in this respect and that the neither the depression 60 nor the covering 61 is required.

The base 54 of the hook 50 may include a bore 62 to receive the insert 56 and may be attached to the insert 56 with the use of a rivet 70, or any other suitable fastener. An axially extending groove or ridge 74 may be formed on the insert 56 to engage with a corresponding mating feature 75 on the base 54 to reduce the possibility of relative rotation. It is to be appreciated, however, that other suitable anti-rotation features may be used. The hook 50 may also be used to receive the laces of the boot to maintain the tongue 22 in a relatively central position with respect to the boot.

Figure 6:
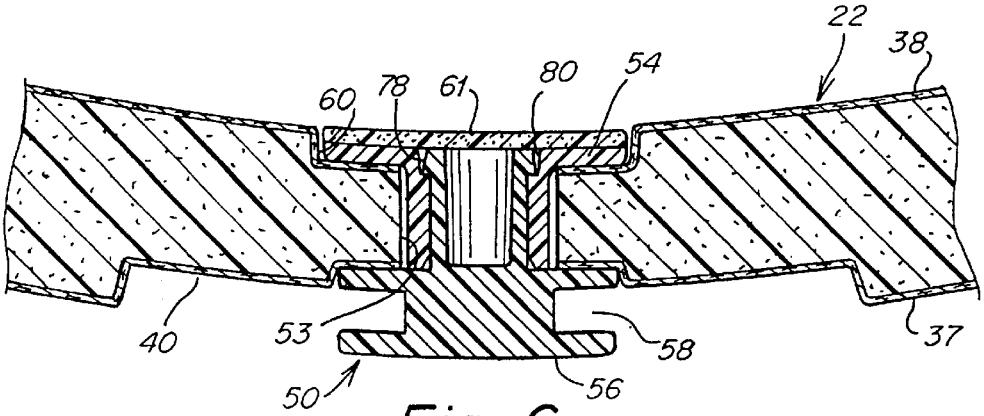
FIG. 6 is a cross-sectional view of an alternative tongue construction of FIG. 5.

In an alternative embodiment, as shown in FIG. 6, the insert 56 may have an annular ring 78 to snap fit into a corresponding groove 80 formed in the base 54, thereby obviating the need for the rivet or other fastener. Although not shown, this embodiment may also include a suitable anti-rotation feature to reduce the possibility of rotation of the hook 50.

Figure 7:
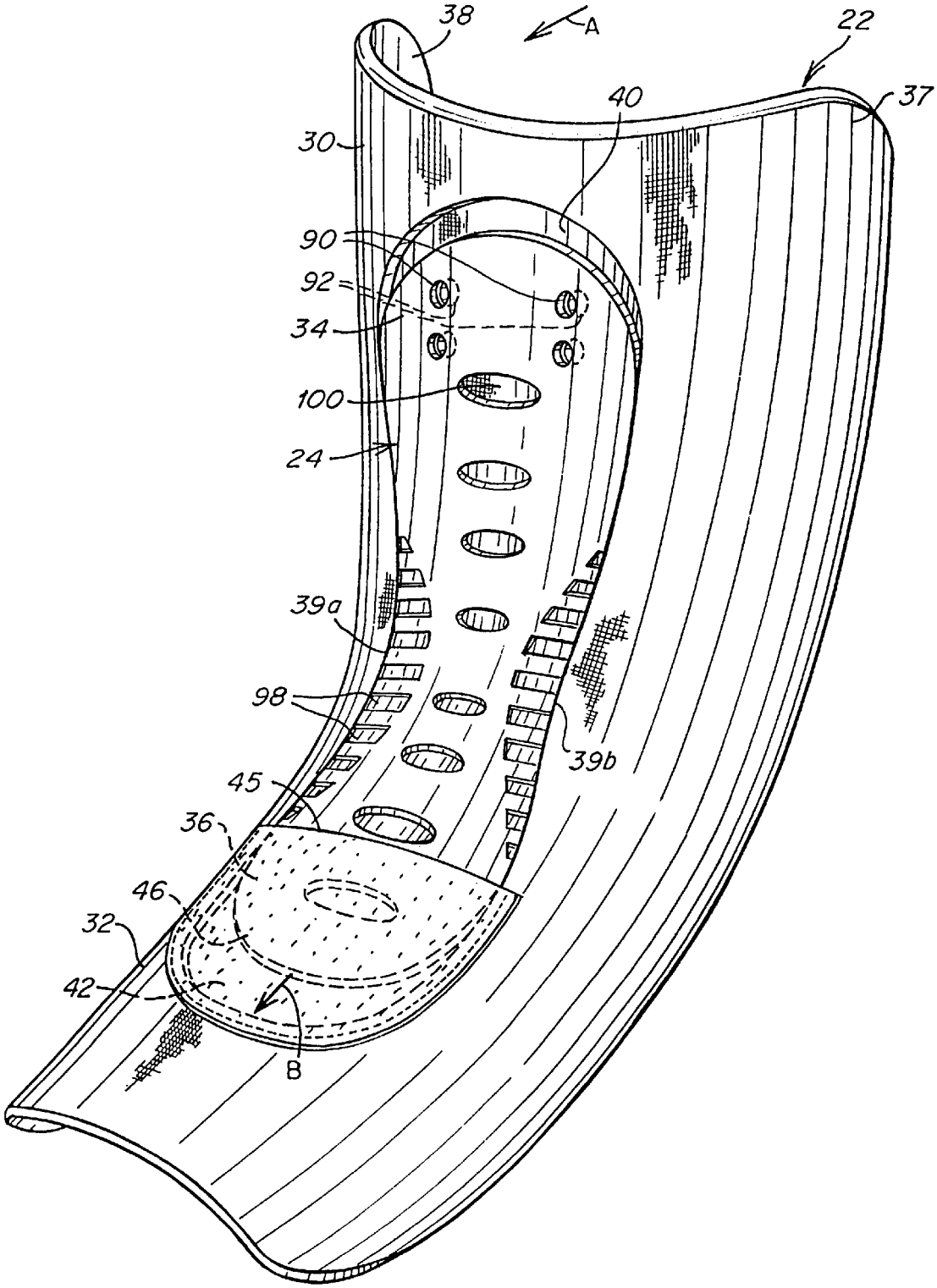
FIG. 7 is a perspective view of an alternative tongue construction.

As described above, the present invention is not limited to any particular attachment mechanism to secure the stiffener 24 to the tongue 22 and other suitable arrangements may be used. In this respect, referring in particular to FIG. 7, an alternative embodiment for attaching the stiffener 24 to the tongue 22 is shown. In this illustrative embodiment, the upper end 34 of the stiffener 24 may include one or more eyelets 90 for receiving the lace of the boot. The tongue 22 may also be formed with one or more corresponding eyelets 92. Thus, the lace may be used to secure the upper end 34 of the stiffener 24 to the tongue 22, while centering the tongue 22 relative to the boot.

The tongue stiffener 24 as shown in FIG. 1, may be conformable to approximate the contour of the tongue or be sufficiently flexible to conform to the surface of the tongue as the tongue stiffener is drawn to the surface of the tongue by, for example, the closure device of the boot or the straps of the binding. In this embodiment, the stiffener body includes a medial side 39*a* and a lateral side 39*b*, each extending between the upper end 34 and the lower ends 36. The stiffener body may be formed with a concave top surface in a direction that extends from the upper end 34 to the lower end 36 and may also include a convex top surface in a direction that extends from the medial side 39*a* to the lateral side 39*b*. The surface of the stiffener that conforms to the contour of the tongue preferably includes a smooth surface having limited projections extending therefrom which would otherwise interfere with the surface of the tongue upon sliding of the stiffener relative to the tongue. In addition, the surface that approximates the shape of the tongue also includes a complementary shaped surface to that of the top surface. Namely, the bottom surface is convex in a direction that extends from the upper end 34 to the lower end 36 and includes a concave surface in a direction that extends from the medial side 39*a* to the lateral side 39*b*.

The sides 39*a*, 39*b* may taper toward each other at the mid-section of the stiffener such that the resulting shape resembles an hour-glass. This reduced width at the mid-section also allows a change in the stiffness of certain portions of the stiffener relative to other portions. In this respect, the stiffener may easily bend about the mid-section. The tapered sides, and resulting hour-glass shape, also limits the amount of material at the mid-section so that, as the tongue is flexed forward, the sides may remain substantially in contact with the tongue surface, thereby minimizing bulging of the stiffener. However, the present invention is not limited in this respect and that other suitable methods for causing the sides to remain in contact with the tongue may be employed. In this regard, the stiffener may be formed with straight sides, each having a laterally extending slit formed therein at generally the midsection of the stiffener. Thus, as the tongue and stiffener is flexed forward, the sidewalls separate at the slit, thereby causing the sides to substantially remain in contact with the tongue surface and minimizing bulging of the stiffener. In another example, the sides of the stiffener may be formed with a relatively elastic material so as to conform to the resulting shape of the flexed tongue.

In one illustrative embodiment, the width of the tongue stiffener is less than the width of the tongue and also may be less than about the distance between eye stays 120*a* and 120*b* (see FIG. 1) of a boot when in the secured position. In one embodiment, the width of the tongue stiffener is preferably less than 3 inches, more preferably less than 2.5 inches, and even more preferably less than about 2.25 inches. The width of the tongue may be about 7 inches. The length of the tongue stiffener may be less than about 7 inches, and more preferably less than about 6 inches, and the length of the tongue may be about 10 inches.

In some instances, it may be desirable to control the flexibility of the tongue 22 and subsequently the boot and this flexibility may be controlled in a number of ways. The stiffener 24 may be removable from the tongue 22 allowing the rider to choose between a more stiff boot (with the stiffener 24 attached) and a more flexible boot (with the stiffener 24 removed). The boot may be also be provided with interchangeable stiffeners 24, each having a different flexibility. Thus, the wearer may select from a variety of stiffeners to alter the properties of the boot. The flexibility or rigidity of the stiffeners 24 themselves may be varied in any of a number of ways; for example, by forming the stiffeners with different materials or by forming the stiffeners with different shapes or dimensions. In one illustrative embodiment, a stiffener 24 may be formed of a semi-rigid material such as thermal plastic polyester elastomer so that it is stiffer than the tongue. In one embodiment, the tongue stiffener may have a durometer of about 74 Shore D and the tongue may have a durometer of between about 55 and about 58 Asker C. Of course, the tongue and tongue stiffener may be configured with other suitable hardnesses.

One example of suitable material forming the tongue stiffener, such as a thermal plastic polyester elastomer, is Hytrel®, which may be purchased from the E. I. du Pont de Nemours and Company, USA. Other suitable plastics, such as thermoplastic polyurethane or nylon, may be used for this or other stiffeners. Also, non-plastic materials may be used. The stiffener may also be formed of two or more materials, each material having a different stiffness. Each material may be formed at a discrete location on the stiffener body, thereby causing the stiffener body to have a varied stiffness.

As mentioned, the flexibility or rigidity of the stiffener 24 also may be adjusted by providing the stiffeners with different shapes. For example, controlling the dimensions of the hour-glass shape may aid in providing the stiffener with a desired stiffness. In addition, one or both sides 39*a*, 39*b* may include a plurality of flex inducing members such as grooves or notches 98 having a bottom and a sidewall. The grooves 98 may be sized and shaped to provide a desired rigidity or stiffness at least to a portion of the stiffener, such as the midsection. In this respect, due in part to the presence of the grooves, the mid-section is able to flex to a greater extent than other portions of the stiffener. The grooves 98 may also act to minimize kinking of the mid-section of the stiffener as the tongue and stiffener are flexed. In this respect, the grooves 98 provide controlled flexing of the stiffener.

In addition, at least one aperture 100 may be formed completely through the stiffener 24, with the aperture 100 being shaped and dimensioned in accordance with the desired flexibility or rigidity Like the grooves 98, the apertures 100 may also act to minimize kinking of the stiffener as the tongue and stiffener are flexed. The flexibility or rigidity of a single stiffener 24 may be further adjusted by providing a stiffness adjuster 102, which may fit into the aperture 100, or any other suitable aperture formed in the stiffener. Of course, the stiffness adjuster 102 need not be placed into an aperture of the stiffener, but rather may be attached to one or more locations on the surface or periphery of the stiffener body. A variety of inserts may be supplied, each rendering the stiffener 24 with a different degree of stiffness. The stiffness adjuster may be formed of an elastomer or any other suitable material. Accordingly, a wearer may adjust the flexibility by selecting a desired type or number of stiffness adjusters 102.

The various embodiments of the tongue stiffener described may be used with any suitable footwear cooperating with a tongue. In one example, as shown in FIG. 1, a soft or hybrid snowboard boot 20 the tongue 22 is attached to the boot upper 26, which extends from a flexible sole 28, near a toe area of the boot upper 26. The tongue may be a molded tongue or a stitched tongue. A fabric may be stretched over the tongue. The tongue may be joined to the upper by stitching, bonding or other suitable joining arrangements as would be apparent to one of skill in the art. The upper is formed of a suitable material, such as leather. To provide traction on snow covered terrain, the sole 28 may be formed with treads. The sole 28 may also include a foam inner sole or midsole to dampen shock transmission to the rider's feet induced during various maneuvers, such as landing jumps. An inner bladder or boot liner, whether permanent or removable, may also be provided for a snug fit and insulation from cold temperatures, snow and water. The boot may be constructed with any suitable closure device, such as buckles, laces, rotary closure systems and the like. Although the tongue 22 is shown attached to the boot upper 26, it should be appreciated that the present invention is not limited in this respect. Instead, the upper 26 may be formed without a tongue, and the tongue may be part of the inner bladder. In addition, the tongue 22 may be a free-floating tongue.

For ease of understanding, and without limiting the scope of the invention, the tongue stiffener for footwear to which this patent is addressed is discussed below particularly in connection with a snowboard boot. However, it should be appreciated that the present invention is not limited in this respect, and that the aspects of the present invention described below can be used in association with other types of footwear.

Having thus described certain embodiments of the present invention, various alterations, modification and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalent thereof.

What is claimed is:

1. A snowboard boot constructed as one of a soft snowboard boot and a hybrid snowboard boot, the boot comprising:

a boot body including a flexible upper, at least a portion of which is formed of flexible material, and a sole;

a flexible, non-rigid tongue associated with said boot body; and a tongue stiffener having a stiffness greater than a stiffness of said flexible, non-rigid tongue and including an elongated body having a first portion engaged to said tongue and a second portion being movable relative to said tongue as said tongue is flexed forwardly to reduce pressing of said stiffener into said tongue.

2. The boot according to claim 1, wherein said first portion of said stiffener is removably fixed to said tongue.

3. The boot according to claim 1, wherein said first portion of said stiffener is an upper end of said tongue stiffener.

4. The boot according to claim 1, wherein said second portion of said stiffener is a lower end of said tongue stiffener.

5. The boot according to claim 1, wherein said tongue defines a shin-to-toe direction, with said tongue stiffener being movable substantially along at least said shin-to-toe direction.

6. The boot according to claim 1, wherein said tongue stiffener has a length substantially less than a length of said tongue.

7. The boot according to claim 4, wherein said lower end of said tongue stiffener is spaced from a lower end of said tongue.

8. The boot according to claim 1, wherein said tongue further includes a medial side and a lateral side, said tongue stiffener being movable toward said medial or lateral sides in response to flexing of the boot in a respective medial or lateral direction.

9. The boot according to claim 1, wherein said tongue includes a recess formed in an outward facing surface thereof, said recess receiving said tongue stiffener.

10. The boot according to claim 9, wherein said recess includes a lower edge and wherein a length of said recess is formed larger than a length of said tongue stiffener, thereby defining an open area between a lower end of said tongue stiffener and said lower edge of said recess, said open area facilitating relative movement of said tongue stiffener within said recess.

11. The boot according to claim 9, wherein said recess has a depth of about equal to a thickness of said tongue stiffener such that an extent to which the tongue stiffener protrudes beyond said outward facing surface of said tongue is minimized.

12. The boot according to claim 1, wherein said tongue stiffener overlies said tongue and wherein said tongue is constructed and arranged to maintain said second portion of said stiffener adjacent to said tongue while allowing relative movement between said tongue stiffener and said tongue.

13. The boot according to claim 12, wherein said tongue is constructed and arranged to loosely constrain longitudinal, medial and lateral movement of said tongue stiffener.

14. The boot according to claim 12, further comprising a cover attached to at least said lower end of said tongue, said cover maintaining said second portion of said stiffener adjacent to said tongue while allowing relative movement therebetween.

15. The boot according to claim 1, wherein an end of said tongue stiffener includes a tip having a narrowing dimensioned cross-section, said tip thereby facilitating movement of the stiffener relative to the tongue.

16. The boot according to claim 1, further comprising a hook attached to said tongue to hold said first portion of said stiffener to said tongue.

17. The boot according to claim 16, wherein said tongue stiffener includes a slot engaging with said hook.

18. The boot according to claim 16, wherein said tongue includes an opening and wherein said hook includes a base passing through said opening and a hook insert secured to said base.

19. The boot according to claim 18, wherein said tongue includes a depression formed in an inward facing surface of said tongue, said depression surrounding said opening, said base being received within said depression such that an extent to which the base protrudes beyond said inward facing surface is minimized.

20. The boot according to claim 19, further comprising a foam covering attached over an inward facing side of said base.

21. The boot according to claim 20, wherein said base and said hook insert cooperate with each other to substantially reduce rotation of the hook insert relative to the base.

22. The boot according to claim 18, wherein said hook insert snap fits into engagement with said base.

23. The boot according to claim 1, wherein said boot has a closure device to secure said boot to a wearer and wherein said stiffener includes at least one receiving feature constructed and arranged to cooperate with the closure device such that the closure device secures said first portion of said stiffener to said tongue as the closure device closes said boot.

24. The boot according to claim 1, wherein said boot includes a pair of eye stays configured to draw toward each other upon tightening of said boot to a wearer, the eye stays defining a resulting space therebetween, the stiffener having a width sufficient to lie within said resulting space without interference with the eye stays.

25. The boot according to claim 23, wherein said receiving feature centers said tongue and said tongue stiffener relative to said boot upon closing said boot about the wearer.

26. The boot according to claim 23, wherein said receiving feature is an eyelet formed in said tongue stiffener, said eyelet constructed and arranged to receive a lace of said boot.

27. The boot according to claim 1, wherein the stiffness of the tongue stiffener is suitable to provide a substantial resistance to flexing beyond a forward flex angle of about 45°.

28. The boot according to claim 1, wherein said tongue stiffener includes at least one aperture formed therein.

29. The boot according to claim 1, further comprising at least one stiffness adjuster cooperating with said tongue stiffener to selectively change the stiffness of said tongue stiffener.

30. The boot according to claim 28, further comprising a stiffness adjuster placed within said at least one aperture to selectively change the stiffness of said tongue stiffener.

31. The boot according to claim 1, wherein said tongue stiffener overlies said tongue.

32. The boot according to claim 1, wherein the stiffener body includes a flex inducing member formed therein.

33. The boot according to claim 32, wherein said stiffener body is formed in an hour-glass shape defining a waist area.

34. The boot according to claim 33, wherein said stiffener body includes sidewalls and wherein said flex inducing member comprises a plurality of flex inducing members formed along said sidewalls in said waist area.

35. The boot according to claim 1, further comprising a plurality of interchangeable stiffeners, each stiffener being removably attached to said tongue at said first portion of said stiffener, each stiffener having a different flexibility.

36. The boot according to claim 1, further comprising means for attaching said first stiffener portion to said tongue.

37. The boot according to claim 1, further comprising an attachment member constructed and arranged to attach said first portion of said stiffener to said tongue.

38. The boot according to claim 1, further comprising a pocket attached to and disposed at a lower end of said tongue, said pocket maintaining said second portion of said stiffener adjacent to said tongue while allowing relative movement therebetween.

39. The boot according to claim 38, further comprising a pocket attached to and disposed at an upper end of said tongue, said pocket maintaining said first stiffener portion adjacent to said tongue while allowing relative movement therebetween.

40. The boot according to claim 39, wherein said tongue stiffener includes a midsection portion that free from attachment to the tongue.

41. The boot according to claim 1, wherein said tongue stiffener includes a midsection portion that is a free from attachment to the tongue.

42. A snowboard boot constructed as one of a soft snowboard boot and a hybrid snowboard boot, the boot comprising:

a boot body having a sole and a flexible upper, at least a portion of which is formed of flexible material;

a flexible, non-rigid tongue associated with said boot body;

a stiffener having a stiffness greater than a stiffness of said flexible, non-rigid tongue; and a post mounted to said flexible, non-rigid tongue;

said stiffener including an opening for releasbly engaging said stiffener to said post so that said stiffener is mounted to said flexible, non-rigid tongue, wherein at least a portion of said stiffener is movable relative to said tongue as said tongue is flexed forwardly to reduce pressing of said stiffener into said tongue.

43. The boot according to claim 42, wherein said first portion of said stiffener is removably fixed to said tongue.

44. The boot according to claim 42, wherein said first portion of said stiffener is an upper end of said tongue stiffener.

45. The boot according to claim 42, wherein said second portion of said stiffener is a lower end of said tongue stiffener.

46. The boot according to claim 42, wherein said tongue defines a shin-to-toe direction, with said tongue stiffener being movable substantially along at least said shin-to-toe direction.

47. The boot according to claim 42, wherein said tongue further includes a medial side and a lateral side, said tongue stiffener being movable toward said medial or lateral sides in response to flexing of the boot in a respective medial or lateral direction.

48. The boot according to claim 42, wherein said tongue stiffener overlies said tongue and wherein said tongue is constructed and arranged to maintain said second portion of said stiffener adjacent to said tongue while allowing relative movement between said tongue stiffener and said tongue.

49. The boot according to claim 42, wherein said tongue is constructed and arranged to loosely constrain longitudinal, medial and lateral movement of said tongue stiffener.

50. The boot according to claim 42, wherein the stiffness of the tongue stiffener is suitable to provide a substantial resistance to flexing beyond a forward flex angle of about 45°.

51. The boot according to claim 42, wherein said tongue stiffener overlies said tongue.

52. The boot according to claim 42, wherein said stiffener body is formed in an hour-glass shape defining a waist area.

53. The boot according to claim 42, further comprising a pocket attached to and disposed at a lower end of said tongue, said pocket maintaining said second portion of said stiffener adjacent to said tongue while allowing relative movement therebetween.

54. The boot according to claim 42, wherein said tongue stiffener includes a midsection portion that is free from attachment to the tongue.

55. A snowboard boot constructed as one of a soft snowboard boot and a hybrid snowboard boot, the boot comprising:

a boot body having a sole and a flexible upper, at least a portion of which is formed of flexible material;

a flexible, non-rigid tongue associated with said boot body, said tongue including a pocket;

a stiffener having a stiffness greater than a stiffness of said flexible, non-rigid tongue, said stiffener having a first portion and a second portion, one of the first and second portions being supportable within said pocket when said tongue is in a rest position and which is movable relative to said tongue as said tongue is flexed forwardly to reduce pressing of said stiffener into said tongue.

56. The boot according to claim 55, wherein said first portion of said stiffener is removably fixed to said tongue.

57. The boot according to claim 55, wherein said first portion of said stiffener is an upper end of said tongue stiffener.

58. The boot according to claim 55, wherein said second portion of said stiffener is a lower end of said tongue stiffener.

59. The boot according to claim 55, wherein said tongue defines a shin-to-toe direction, with said tongue stiffener being movable substantially along at least said shin-to-toe direction.

60. The boot according to claim 55, wherein said tongue further includes a medial side and a lateral side, said tongue stiffener being movable toward said medial or lateral sides in response to flexing of the boot in a respective medial or lateral direction.

61. The boot according to claim 55, wherein said tongue stiffener overlies said tongue and wherein said tongue is constructed and arranged to maintain said second portion of said stiffener adjacent to said tongue while allowing relative movement between said tongue stiffener and said tongue.

62. The boot according to claim 55, wherein said tongue is constructed and arranged to loosely constrain longitudinal, medial and lateral movement of said tongue stiffener.

63. The boot according to claim 55, wherein the stiffness of the tongue stiffener is suitable to provide a substantial resistance to flexing beyond a forward flex angle of about 45°.

64. The boot according to claim 55, wherein said stiffener body is formed in an hour-glass shape defining a waist area.

65. The boot according to claim 55, wherein said pocket maintains said second portion of said stiffener adjacent to said tongue while allowing relative movement therebetween.

66. The boot according to claim 55, wherein said pocket maintains said first portion adjacent to said tongue while allowing relative movement therebetween.

67. The boot according to claim 55, wherein said tongue stiffener includes a midsection portion that is free from attachment to the tongue.

68. A snowboard boot constructed as one of a soft snowboard boot and a hybrid snowboard boot, the boot comprising:

a boot body including a flexible upper, at least a portion of which is formed of flexible material, and a sole;

a tongue associated with said boot body; and a tongue stiffener overlying said tongue, said tongue stiffener including an elongated body having a first portion engaged to said tongue and a second portion being movable relative to said tongue as said tongue is flexed forwardly to reduce pressing of said stiffener into said tongue.

69. The boot according to claim 68, wherein said first portion of said stiffener is removably fixed to said tongue.

70. The boot according to claim 68, wherein said first portion of said stiffener is an upper end of said tongue stiffener.

71. The boot according to claim 68, wherein said second portion of said stiffener is a lower end of said tongue stiffener.

72. The boot according to claim 68, wherein said tongue defines a shin-to-toe direction, with said tongue stiffener being movable substantially along at least said shin-to-toe direction.

73. The boot according to claim 68, wherein said tongue further includes a medial side and a lateral side, said tongue stiffener being movable toward said medial or lateral sides in response to flexing of the boot in a respective medial or lateral direction.

74. The boot according to claim 68, wherein said tongue is constructed and arranged to loosely constrain longitudinal, medial and lateral movement of said tongue stiffener.

75. The boot according to claim 68, further comprising a hook attached to said tongue to hold said first portion of said stiffener to said tongue.

76. The boot according to claim 75, wherein said tongue stiffener includes a slot engaging with said hook.

77. The boot according to claim 68, wherein the stiffness of the tongue stiffener is suitable to provide a substantial resistance to flexing beyond a forward flex angle of about 45°.

78. The boot according to claim 68, wherein said stiffener body is formed in an hour-glass shape defining a waist area.

79. The boot according to claim 68, further comprising means for attaching said first stiffener portion to said tongue.

80. The boot according to claim 68, further comprising an attachment member constructed and arranged to attach said first portion of said stiffener to said tongue.

81. The boot according to claim 68, further comprising a pocket attached to and disposed at a lower end of said tongue, said pocket maintaining said second portion of said stiffener adjacent to said tongue while allowing relative movement therebetween.

82. The boot according to claim 81, further comprising a pocket attached to and disposed at an upper end of said tongue, said pocket maintaining said first stiffener portion adjacent to said tongue while allowing relative movement therebetween.

83. The boot according to claim 82, wherein said tongue stiffener includes a midsection portion that is free from attachment to the tongue.

84. The boot according to claim 68, wherein said tongue stiffener includes a midsection portion that is free from attachment to the tongue.

* * * * *